US007832232B2

(12) United States Patent
Wilson

(10) Patent No.: US 7,832,232 B2
(45) Date of Patent: Nov. 16, 2010

(54) COMBINATION RESTRICTOR CARTRIDGE

(75) Inventor: Shawn T. Wilson, Fort Wayne, IN (US)

(73) Assignee: Parker-Hannifin Corporation, Cleveland, OH (US)

( * ) Notice: Subject to any disclaimer, the term of this patent is extended or adjusted under 35 U.S.C. 154(b) by 419 days.

(21) Appl. No.: 11/767,552

(22) Filed: Jun. 25, 2007

(65) Prior Publication Data

US 2008/0000255 A1 Jan. 3, 2008

Related U.S. Application Data

(60) Provisional application No. 60/817,979, filed on Jun. 30, 2006, provisional application No. 60/925,557, filed on Apr. 20, 2007.

(51) Int. Cl.
*F25B 41/06* (2006.01)
*F25B 13/00* (2006.01)

(52) U.S. Cl. ..... 62/527; 62/324.6

(58) Field of Classification Search ..... 62/222, 62/296, 324.6, 511, 527
See application file for complete search history.

(56) References Cited

U.S. PATENT DOCUMENTS 3,422,842 A * 1/1969 Erickson ..... 137/504
3,992,898 A * 11/1976 Duell et al. ..... 62/324.6
4,100,894 A 7/1978 Tamura
4,869,290 A 9/1989 Sepso et al.
4,896,696 A 1/1990 Bradley et al.
5,265,438 A 11/1993 Knowles et al.
5,345,780 A 9/1994 Aaron et al.
5,507,468 A 4/1996 Evans
5,706,670 A 1/1998 Voorhis
5,715,862 A 2/1998 Palmer
5,966,960 A * 10/1999 Cummings et al. ..... 62/296
6,363,965 B1 4/2002 Carmack et al.
6,560,987 B2 5/2003 Kreger et al.
2004/0089349 A1* 5/2004 Meyer ..... 137/517
2005/0204769 A1* 9/2005 Oberley et al. ..... 62/324.6

* cited by examiner

*Primary Examiner*—Frantz F Jules
*Assistant Examiner*—Emmanuel Duke
(74) *Attorney, Agent, or Firm*—Robert J. Clark

(57) ABSTRACT

A bi-directional flow control device utilizes a single moveable restrictor housed within a cartridge, the piston having a first position wherein the piston orifice provides a smallest diameter flow path through the cartridge, and a second position wherein a cartridge orifice provides a smallest diameter flow path through the cartridge. In one embodiment the device utilizes an anti-rattle mechanism for reducing rattle of the piston within the internal chamber of the cartridge.

6 Claims, 3 Drawing Sheets

COMBINATION RESTRICTOR CARTRIDGE

CROSS REFERENCE TO RELATED APPLICATIONS

The present application claims the benefit of the filing date of U.S. Provisional Patent Application Ser. No. 60/925,557, filed Apr. 20, 2007 which claims the benefit of U.S. Provisional Patent Application Ser. No. 60/817,979, filed Jun. 30, 2006 the disclosure of which is incorporated herein by reference.

TECHNICAL FIELD

The present invention relates to bi-directional flow devices of the type that are particularly useful for through the wall packaged terminal air conditioner (PTAC) units and small air conditioning units used in recreational vehicles, and more particularly, to a bi-directional flow device utilizing a single floating restrictor.

BACKGROUND

Fluid circuits, such those used in refrigeration and heat pump circuitry, may use a restrictor for controlling the flow through the conduit. The restrictor may be for the purpose of controlling the rate of flow in one direction and permitting unrestricted flow in the other direction. An example of a uni-directional flow control device in the form of a floating restrictor is shown U.S. Pat. No. 4,896,696 issued to Bradley, et al., on Jan. 30, 1990 and is hereby incorporated by reference. However, in a heat pump, the change from the cooling function to the heating function, and vice versa, is achieved by reversing the direction of refrigerant flow in the system. This requires by-pass conduits and check valves to be used with a uni-directional flow control device in each flow direction.

Bi-directional flow control has been accomplished by using two floating restrictor devices back-to-back as shown in U.S. Pat. No. 5,265,438 issued to Knowles, et al. on Nov. 30, 1993 and is hereby incorporated by reference. The bi-directional flow control devices eliminate the need for by-pass conduits and check valves to redirect flow on a change from the cooling function to the heating function.

However, the bi-directional flow device requires two floating restrictors and associated cartridges. It would therefore be a significant advantage over the prior art to provide bi-directional flow control using a flow control device with a single floating restrictor.

Another problem with floating restrictor devices is that may produce relatively high velocities adjacent the restrictor, and it is common for operational noises to be generated. Such noise may be in the form of a rattle, or other vibrations produced by the flow and turbulence of the fluid as it passes around and through the restrictor.

It would therefore be a significant advantage over the prior art to provide a floating restrictor having an anti-rattle mechanism.

SUMMARY OF THE INVENTION

At least one improvement over the prior art is provided by a flow control device for providing bi-directional flow control, the device comprising: a cartridge having an internal chamber and a cartridge orifice, the internal chamber in fluid connection with the cartridge orifice; and a piston movable within said chamber, the piston having a piston orifice therethrough; the piston having a first position wherein the piston orifice provides a smallest diameter flow path through the cartridge, and a second position wherein the cartridge orifice provides a smallest diameter flow path through the cartridge.

At least one improvement over the prior is also provided by a flow control device for providing bi-directional flow control, the device comprising: a cartridge having an internal chamber and a cartridge orifice, the internal chamber in fluid connection with the cartridge orifice; and a piston movable within said chamber, the piston having a piston orifice therethrough; the piston having a first position adjacent an end of the cartridge orifice and a second position distal from the cartridge orifice; and an anti-rattle mechanism positioned between the chamber of the cartridge and an outer surface of the piston for reducing rattle of the piston within the chamber of the cartridge.

At least one improvement over the prior is also provided by a method for providing bi-directional flow control comprising the steps of: providing a cartridge having an internal chamber and a cartridge orifice, the internal chamber in fluid connection with the cartridge orifice, and a piston movable within said chamber, the piston having a piston orifice therethrough; directing a flow of refrigerant through the cartridge in a first direction such that the piston moves adjacent an end of the cartridge orifice wherein the fluid flow is restricted by the piston orifice; directing a flow of refrigerant through the cartridge in a second direction such that the piston moves away from the end of the cartridge orifice wherein the fluid flow is restricted by the cartridge orifice and the refrigerant expands upstream of the piston.

BRIEF DESCRIPTION OF THE DRAWINGS

Embodiments of this invention will now be described in further detail with reference to the accompanying drawings, in which.

DESCRIPTION OF DRAWINGS

Figure 1:
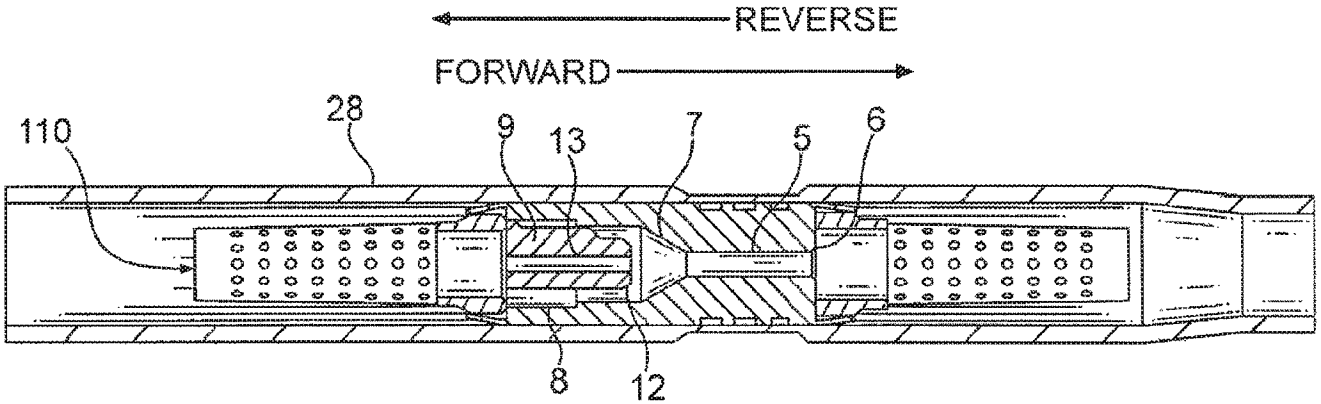
FIG. 1 is a cross-sectional view showing an embodiment of the flow control device of the present invention positioned within a tube.
Figure 2:
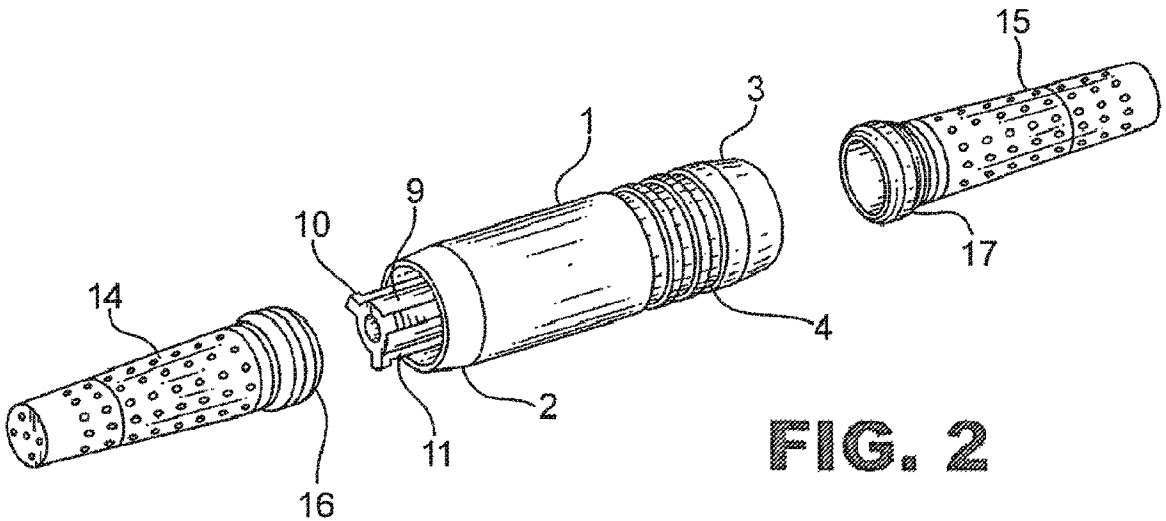
FIG. 2 is an exploded perspective view of the flow control device of FIG. 1.

FIG. 1 shows an embodiment of the flow control device 110 of the present invention is shown positioned in a tube 28, typically a copper tube, in which the flow control device 110 is secured by a crimping process. FIG. 2 shows the flow control device 110 in an exploded view. Referring now to FIGS. 1 and 2, the flow control device 110 comprises a cartridge body 1. An external surface of the cartridge body 1 has a plurality of prominent ridges 4. These ridges 4 have a dual purpose; first, they ensure that the cartridge body 1 is captivated securely in the copper tube 28 securely during the crimping process, second, they prevent uncontrolled refrigerant flow around the external surface of the cartridge body 1.

The cartridge 1 has an orifice 5 formed therethrough which expands at tapered surface 7 into an internal cavity 8. The internal cavity 8 functions as a chamber to accommodate a flow restrictor in the form of piston 9. A filter screen 14, 15 is attached to either end of the cartridge 1. In the embodiment shown, a counterbore is formed in each end of the cartridge 1. The filter screen ends, or screen collars, 16, 17, respectively, are inserted into the counterbores and secured to the cartridge by swageing the ends of the cartridge 1. In one embodiment, the screen 14 farthest from the ridges 4 is attached initially, captivating the piston 19 within the internal cavity 8. The cartridge assembly is then placed in the copper tube 28 for the final assembly step. At this point, the second screen 15 is loosely placed in position on the top end 3 of the cartridge 1. The top end 3 of the cartridge 1 is then swageed to attach the filter screen 15 to the cartridge 1. To eliminate an extra step, the copper tube 28 and the top end 3 of the cartridge 1 may be crimped and swaged simultaneously.

The piston 9 illustrated has a spherical nose 12, a plurality of flutes 11 and a winged edge 10 that serves as a poke yoke feature to prevent inserting the piston 9 into the cavity 8 of the cartridge 1 in wrong direction. This winged edge 10 has an added role of providing a controlled stop against the collar 16 of the filter screen 14. An orifice 13 is formed through the longitudinal axis of the piston. Any number of flutes 11 other than three and a differing edge 10 may be used on the piston 9.

As refrigerant flows in the forward direction, the refrigerant moves the piston 9 to a first position adjacent the end of the orifice 5 of the cartridge 1 where a leak free seal is created between the nose 12 of the piston 9 and the tapered surface 7 in the cartridge cavity 8. This interface between the piston 9 and the tapered surface 7 ensures that flow is controlled by the orifice 13 of the piston 9, the orifice 13 representing the smallest diameter in the flow path.

When flow has been reversed, the piston 9 unseats and moves to a position distal from the end of the orifice 5 and backstops on the screen collar 16 creating a flow passage around its external body as well as through piston orifice 13. This enables the fixed cartridge 1 to play a dominant role in controlling the refrigerant flow because, at this point, the orifice 5 for the fixed cartridge 1 is the smallest diameter in the flow path.

Figure 3:
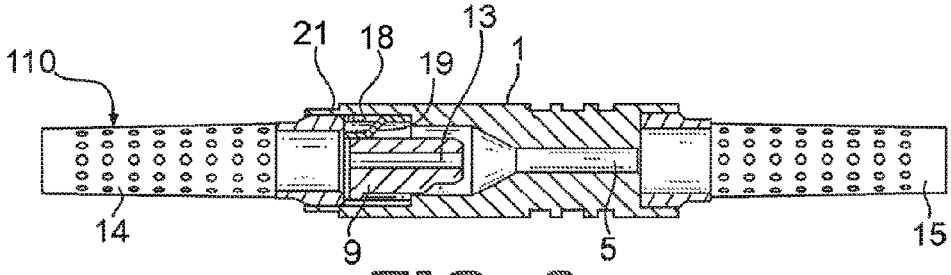
FIG. 3 is a cross-sectional view of a second embodiment of the flow control device of the present invention.
Figure 4:
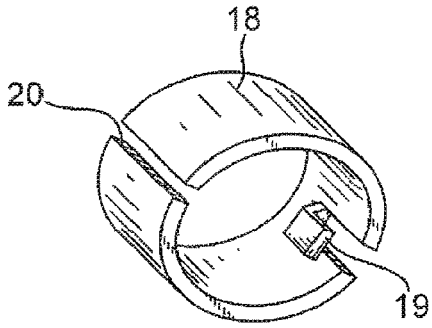
FIG. 4 is a perspective view of the anti-rattle mechanism shown in FIG. 3.

However, in some applications the flow restrictor embodiment shown in FIGS. 1 and 2 may be susceptible to piston rattle. The rattle is primarily caused by the piston 9 being downstream of the expanding refrigerant when the refrigerant flows in the reverse direction. A second embodiment of the present invention is shown in FIGS. 3 and 4 and provides an anti-rattle mechanism. The anti-rattle mechanism, best shown in a perspective view in FIG. 4 comprising a sleeve or band 18 generally having a C-shaped cross-section, ends 20, and at least one spring arm or prong 19 generally extending radially inward of the sleeve 18. The sleeve 18 is inserted into the cavity 8 of the cartridge 1 by squeezing the outer walls of the sleeve 18. This temporarily reduces the diameter of the sleeve 18 allowing easy insertion into the housing cavity 8. When inserted and released, the sleeve 18 will spring outward creating a tight friction fit inside the housing cavity 8. The sleeve 18 will also be supported in the axial direction by the position of screen collar 16. Spring arm 19 will provide sufficient damping force against the piston 9 to prevent rattle of the piston 9 while allowing the piston 9 to slide back and forth under refrigerant fluid pressures. It is noted that the piston 9 is generally the same as the piston in the previous embodiment. Accordingly, the cavity diameter is slightly increased to accommodate the thickness of the sleeve 18. It is also possible to decrease the size of the piston 9 to accommodate the thickness of the sleeve 18.

In the embodiment shown in FIG. 3, the outside diameter of the end of the cartridge 1 was reduced as shown at 21 to safely attach the screen at the cavity end with a swaging process. This difference in wall thickness at swage area will ensure deformation of the cartridge 1 in a controlled manner without any deformation done to the body cavity 8.

Figure 5:
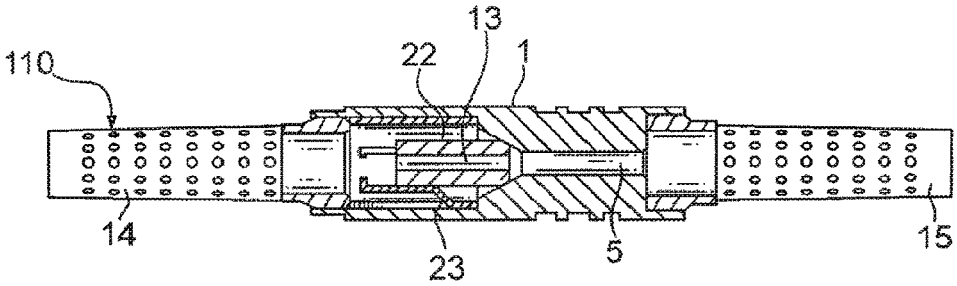
FIG. 5 is a cross-sectional view of a third embodiment of the flow control device of the present invention.
Figure 6:
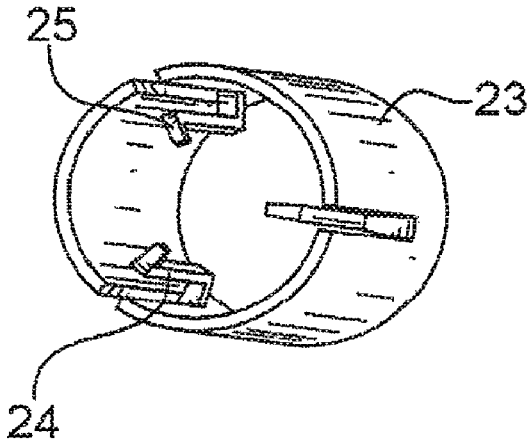
FIG. 6 is a perspective view of the anti-rattle mechanism shown in FIG. 5.
Figure 7:
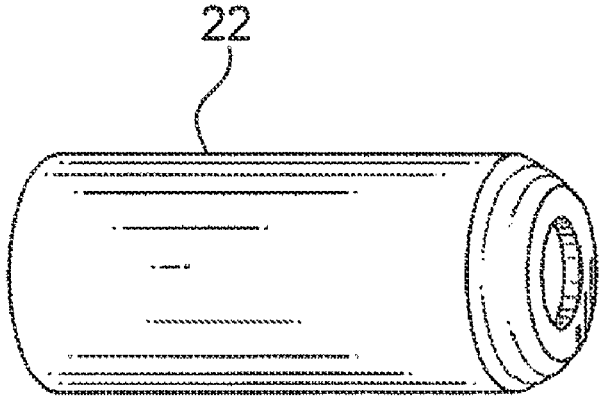
FIG. 7 is a perspective view of the piston shown in FIG. 5.

Another embodiment of the invention is shown in FIGS. 5-7. In this embodiment, a generally cylindrical piston 28 (still having a tapered nose) is utilized in that it does not have any flutes and wings as best shown in FIG. 7. In this embodiment, a sleeve 23 is also utilized. Sleeve 23 has at least two prongs (three shown herein) or arms 24 generally extending radially inward of the sleeve, the at least three arms each having a generally axially extending portion engaging the piston 8 and a stop portion 25 extending radially inward from the respective arm to limit the movement of the piston 8. Accordingly, the arms 24 act as guides for piston travel, and also provide a backstopping means when flow in the reverse direction is desired. The arms 24 also act as a mechanism to reduce piston vibration. As with the previous embodiment, the sleeve 23 will be retained in the cavity by spring loading and/or the inboard end of the screens 14, 15.

It is noted that the cartridge orifices shown in FIGS. 3 and 5 are slightly larger in diameter than the piston orifices shown in the corresponding figures. In this manner, as with the first embodiment, the piston orifice provides the smallest cross-sectional fluid pathway when the piston is engaged and the cartridge orifice provides the smallest cross-sectional fluid pathway when the piston is disengaged.

Accordingly, the combination restrictor cartridge of the present invention provides bi-directional flow, while eliminating the need for a secondary floating restrictor and cartridge assembly as required by the prior art. This is accomplished by utilizing the cartridge as a housing for the floating restrictor and a flow control orifice. In operation, flow in the heating direction is controlled by the fluted floating restrictor. In the cooling direction, the fluted floating restrictor is unseated. Flow control is then be controlled by the fixed restrictor/housing. Any rattle caused by the piston being downstream of the refrigerant expansion can be compensated for by an anti-rattle mechanism.

Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention. Accordingly, the scope and content of the present invention are to be defined only by the terms of the appended claims.

What is claimed is:

1. A flow control device for providing bi-directional flow control, the device comprising:

a generally cylindrical cartridge having an internal chamber and a cartridge orifice axially positioned through a portion of the cartridge, the internal chamber in fluid connection with the cartridge orifice;

a single, generally cylindrical piston movable within said chamber, the piston having a piston orifice therethrough, the piston orifice axially positioned through the piston; and the piston having a first position wherein the piston orifice provides a smallest diameter flow path through the cartridge, and a second position wherein the cartridge orifice provides a smallest diameter flow path through the cartridge;

an anti-rattle mechanism for reducing rattle of the piston within the internal chamber of the cartridge, wherein the anti-rattle mechanism comprises a sleeve having at least two arms generally extending radially inward of the sleeve, the at least two arms each having a generally axially extending portion engaging the piston, and wherein each of the at least two arms includes a stop portion extending radially inward from the respective arm to limit the movement of the piston.

2. The flow control device of claim 1, wherein the piston is un-fluted.

3. The flow control device of claim 1, wherein an outer cylindrical surface of the cartridge includes a plurality of ridges.

4. The flow control device of claim 1 further comprising a filter screen attached to each end of the cartridge.

5. The flow control device of claim 3, wherein the thickness of the ends of the cartridge are reduced from the outer diameter of the cartridge to aid in attachment of the filter screens to the ends of the cartridge.

6. A method for providing bi-directional flow control comprising the steps of:

providing a cartridge having an internal chamber and a cartridge orifice, the internal chamber in fluid connection with the cartridge orifice, and a piston movable within said chamber, the piston having a piston orifice therethrough;

directing a flow of refrigerant through the cartridge in a first direction such that the piston moves adjacent an end of the cartridge orifice wherein the piston orifice provides the smallest diameter restriction for the fluid flow through the cartridge;

directing a flow of refrigerant through the cartridge in a second direction such that the piston moves away from the end of the cartridge orifice wherein the cartridge orifice provides the smallest diameter restriction for the fluid flow through the cartridge and the refrigerant expands upstream of the piston; and reducing rattle of the piston caused by refrigerant expanding upstream of the piston by inserting an anti-rattle mechanism between the cartridge and the piston, wherein the anti-rattle mechanism comprises a cylindrical sleeve having at least one arm generally extending radially inward of the sleeve, the at least two arm having a generally axially extending portion engaging the piston preventing rattling of the piston.

* * * * *